US008397685B2

(12) United States Patent
Lowi

(10) Patent No.: US 8,397,685 B2
(45) Date of Patent: Mar. 19, 2013

(54) FUEL INJECTION SYSTEM

(75) Inventor: Alvin Lowi, Rancho Palos Verdes, CA (US)

(73) Assignee: Motiv Engines, LLC, Reno, NV (US)

( * ) Notice: Subject to any disclaimer, the term of this patent is extended or adjusted under 35 U.S.C. 154(b) by 555 days.

(21) Appl. No.: 12/764,425

(22) Filed: Apr. 21, 2010

(65) Prior Publication Data

US 2011/0259304 A1 Oct. 27, 2011

(51) Int. Cl.
*F01B 7/20* (2006.01)

(52) U.S. Cl. ..... 123/50 R; 123/50 A; 123/50 B; 123/51 R; 123/51 A; 123/51 B

(58) Field of Classification Search ..... 123/50 R, 123/50 A, 50 B, 51 R, 51 A, 51 B
See application file for complete search history.

(56) References Cited

U.S. PATENT DOCUMENTS

| | | | | |
|---|---|---|---|---|
| 2,821,968 | A | 2/1958 | Friedrich | |
| 5,277,222 | A | 1/1994 | Clarke | |
| 5,339,775 | A | 8/1994 | Clarke et al. | |
| 5,448,979 | A | 9/1995 | Clarke | |
| 5,456,219 | A | 10/1995 | Clarke | |
| 5,542,382 | A | 8/1996 | Clarke | |
| 5,566,549 | A | 10/1996 | Clarke | |
| 5,623,894 | A | 4/1997 | Clarke | |
| 5,647,307 | A | 7/1997 | Clarke et al. | |
| 5,692,462 | A | 12/1997 | Hackett | |
| 5,699,758 | A | 12/1997 | Clarke | |
| 6,182,619 | B1 * | 2/2001 | Spitzer et al. | 123/51 B |
| 6,223,727 | B1 * | 5/2001 | Tahara et al. | 123/470 |
| 6,802,457 | B1 | 10/2004 | Campion et al. | |

OTHER PUBLICATIONS

International Search Report from corresponding Int'l. Appln. No. PCT/US2011/032887, dated Jul. 12, 2011 (2 pp.).
Written Opinion of the Int'l. Searching Authority from corresponding Int'l. Appln. No. PCT/US2011/032887, dated Jul. 12, 2011 (7 pp.).

* cited by examiner

*Primary Examiner* — Noah Kamen
*Assistant Examiner* — Grant Moubry
(74) *Attorney, Agent, or Firm* — William P. O'Sullivan; Sheehan Phinney Bass + Green PA

(57) ABSTRACT

An engine includes a fuel injector support element to support a fuel injector and define a first opening through which the fuel injector can inject fuel. A first piston defines a substantially cylindrical inner chamber and a portal into the substantially cylindrical inner chamber. One or more second pistons are arranged to reciprocate inside the substantially cylindrical inner chamber and to define, in cooperation with the substantially cylindrical inner chamber, a combustion chamber. The first fuel injector support element and the first piston are arranged such that, during engine operation, the first piston reciprocates relative to the first fuel injector support element to thereby cause the first opening and the first portal to move in and out of alignment with one another.

25 Claims, 6 Drawing Sheets

FUEL INJECTION SYSTEM

FIELD OF THE INVENTION

This invention relates to fuel injection for an internal combustion engine.

BACKGROUND

In an internal combustion engine, fuel and an oxidizing agent, such as air, undergo combustion in a combustion chamber. The resulting expansion of high pressure and high temperature gases applies a force to a movable component of the engine, such as a piston causing it to move, thereby, resulting in mechanical energy.

Internal combustion engines are used in a wide variety of applications, including, for example, automobiles, motorcycles, ship propulsion and generation of electricity.

It is generally desirable for internal combustion engines to be compact and highly efficient.

SUMMARY OF THE INVENTION

This invention relates to fuel injection system for an internal combustion engine.

In one aspect, an engine includes a fuel injector support element to support a fuel injector and define a first opening through which the fuel injector can inject fuel. A first piston defines a substantially cylindrical inner chamber and a portal into the substantially cylindrical inner chamber. One or more second pistons are arranged to reciprocate inside the substantially cylindrical inner chamber and to define, in cooperation with the substantially cylindrical inner chamber, a combustion chamber. The first fuel injector support element and the first piston are arranged such that, during engine operation, the first piston reciprocates relative to the first fuel injector support element to thereby cause the first opening and the first portal to move in and out of alignment with one another.

In some implementations, the engine has a first fuel injector supported by the first fuel injector support element.

In a typical implementation, the first fuel injector is arranged to inject fuel into the combustion chamber through the first opening and the first portal when the first opening and the first portal are substantially aligned with each other. The fuel injection typically occurs when the one or more of the second pistons are positioned at or near top dead center in their respective cycles.

According to some embodiments, the engine includes a sealing element between the first fuel injector support element and the first piston. The sealing element is arranged to prevent combustion gases from passing through a space that exists between the first support element and the first piston. The sealing element can be substantially annular.

In some implementations, the engine has one or more surfaces that define a substantially annular groove in either the first fuel injector support element or the first piston and the substantially annular sealing element is supported by the substantially annular groove and extends partially out of the substantially annular groove to contact and seal against a surface of whichever of the first fuel injector support element or first piston does not have the substantially annular groove. In a typical embodiment, during engine operation, the substantially annular sealing element slides against the surface of whichever of the first fuel injector support element or first piston does not have the substantially annular groove.

According to certain embodiments, the sealing element has a compressible portion and a wearable portion. The compressible portion is at least substantially contained within the substantially annular groove and the wearable portion slides against the surface of whichever of the first fuel injector support element or first piston does not have the substantially annular groove.

Some implementations of the engine have an oil delivery mechanism for delivering oil, during engine operation, to the surface against which the sealing element slides.

In some embodiments, the engine has an engine casing and the first fuel injector support element is coupled to the engine casing. In some of such embodiments, the first fuel injector support element is coupled to the engine casing in a manner that enables a user to readily remove the first fuel injector support element from the engine casing.

Certain embodiments of the engine include one or more engine intake valves coupled to the engine casing at a first side of the first piston, a pre-compression chamber between the one or more engine intake valves and the first piston, one or more engine exhaust valves coupled to the engine casing at a second side of the first piston opposite the first side and an exhaust chamber between the one or more engine exhaust valves and the first piston.

According to some implementations, a second fuel injector support element has one or more surfaces to support a second fuel injector and defines a second opening through which the second fuel injector can inject fuel. The first piston has one or more surfaces that define a second portal into the substantially cylindrical inner chamber. The second fuel injector support element and the first piston are arranged such that, during engine operation, the first piston reciprocates relative to the second fuel injector support element to thereby cause the second opening and the second passage to move in and out of alignment with one another.

In certain embodiments, the second fuel injector support element is at a diametrically opposite side of the substantially cylindrical inner chamber relative to the first fuel injector support element. In certain embodiments, a first fuel injector is supported by the first fuel injector support element; and a second fuel injector supported by the second fuel injector support element. During engine operation, the first and second fuel injectors are operable to inject fuel into the combustion chamber at substantially the same time as one another.

Some implementations include two second pistons opposing each other inside the substantially cylindrical inner chamber. The combustion chamber is located within a space inside the substantially cylindrical inner chamber between the two opposing second pistons.

According to certain implementations, the first piston has surfaces that define: one or more combustion chamber intake valves at a first side of the first piston and one or more combustion chamber exhaust valves at a second side of the first piston, opposite the first side.

The engine, in some embodiments, is implemented as a compact compression ignition engine.

In certain implementations, the first piston is arranged to reciprocate along a first axis relative to the engine casing and the one or more second pistons are arranged to reciprocate along a second axis perpendicular to the first axis.

Another aspect includes an engine with a first fuel injector support element having one or more surfaces to support a first fuel injector and define a first opening through which the first fuel injector can inject fuel, a second fuel injector support element having one or more surfaces to support a second fuel injector and define a second opening through which the second fuel injector can inject fuel, a first piston having one or more surfaces that define a substantially cylindrical inner chamber, a first portal into the substantially cylindrical inner chamber and a second portal into the substantially cylindrical inner chamber, and one or more second pistons arranged to reciprocate inside the substantially cylindrical inner chamber and to define, in cooperation with the substantially cylindrical inner chamber, a combustion chamber.

The first and second fuel injector support elements are arranged relative to the first piston such that, during engine operation, the first piston reciprocates relative to the first and second fuel injector support elements, to thereby cause the first and second openings to move in and out of alignment with the first and second portals, respectively.

In some implementations, the engine has a first fuel injector supported by the first fuel injector support element; and a second fuel injector supported by the second fuel injector support element. The first fuel injector can be arranged to inject fuel into the combustion chamber through the first opening and the first passage when the first opening and the first portal are in alignment with one another and the one or more second pistons are at or near top dead center in their respective cycles, and the second fuel injector can be arranged to inject fuel into the combustion chamber through the second opening and the second passage when the second opening and the second portal are in alignment with one another and the one or more second pistons are at or near top dead center in their respective cycles.

According to certain embodiments, the first and second fuel injectors are adapted to inject fuel into the combustion chamber at approximately the same time as one another.

The first passage typically is at a diametrically opposite side of the substantially cylindrical inner chamber as the second passage.

In some implementations, one or more of the following advantages are present.

For example, compact, highly efficient engines may be produced. The engines may be four to six times smaller than conventional engines of comparable power. Additionally, the engines may be 22% to 32% more efficient than currently available diesel engines. Moreover, the engines experience very low levels of vibration when operating. Moreover, the engines have very low mono-nitrogen oxides (NOx) emissions.

The techniques disclosed herein include simple, reliable techniques for injecting fuel into such engines. More particularly, an injection scheme is disclosed that can safely and effectively inject fuel into a moving (i.e., reciprocating) combustion chamber.

Other features and advantages will be apparent from the description and drawings, and from the claims.

DETAILED DESCRIPTION

Figure 1:
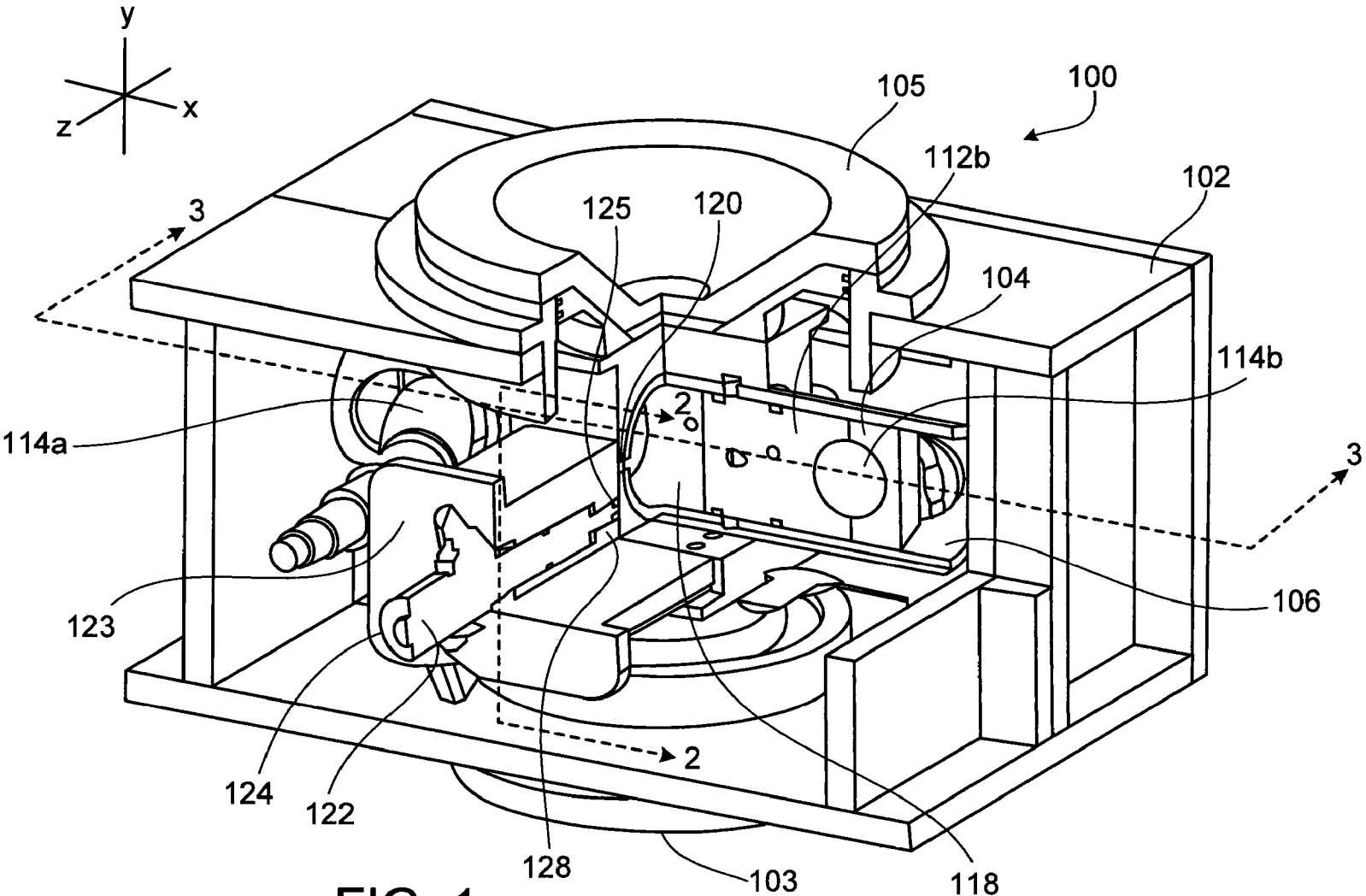
FIG. 1 is a partial cut-away perspective view of an engine.

FIG. 1 is a cut-away perspective view of an engine 100, in which fuel is injected into a combustion chamber through an opening and a passage that periodically line up with one another while the engine is operating.

The illustrated engine 100 includes an engine casing 102. An intake cylinder head 103 is coupled to a lower portion of the engine casing 102 and an exhaust cylinder head 105 is coupled to an upper portion of the engine casing 102.

A first piston (also referred to as a "low pressure piston") 104 is inside the engine casing 102 and is arranged to reciprocate relative to the engine casing 102 along axis y (i.e., vertically, in the illustrated implementation) when the engine is operating.

The low pressure piston assembly 104 has surfaces that define an internal, substantially cylindrical chamber 106 that extends along an axis that is perpendicular to the low pressure piston's axis of movement. More particularly, as shown, the chamber 106 extends horizontally, i.e., along the x-axis. In the illustrated implementation, the chamber 106 has substantially uniform dimensions along its entire length.

A pair of horizontally opposed second pistons (also referred to as "high pressure pistons") 112*a* (not visible in FIG. 1) and 112*b* (visible in FIG. 1) are contained within the chamber 106.

Each high pressure piston 112*a*, 112*b* is arranged for reciprocal motion inside the chamber 106, along a horizontal axis (i.e., the x-axis) relative to the chamber 106 when the engine is operating. Each high pressure piston 112*a*, 112*b* is coupled to an associated crankshaft 114*a*, 114*b*. Each crankshaft 114*a*, 114*b* is supported so that its axis of rotation is fixed relative to the engine casing 102. The movement of each high pressure piston 112*a*, 112*b* relative to its respective crankshaft's axis of rotation causes the low pressure piston 104 to reciprocate in the vertical axis.

Each crankshaft 114*a*, 114*b* has one or more main bearing journals that serve as points of support for the crankshaft and one or more journals that serve as points of connection for one of the high pressure pistons. The crankshafts 114*a*, 114*b* rotate about their respective axes of rotation defined by their associated main bearing journals. The crankshafts 114*a*, 114*b* operate generally to translate the linear, reciprocal motion of each associated high pressure piston 112*a*, 112*b* inside and relative to chamber 106 into a rotational movement.

In some implementations, one of more oil cooling tubes may extend through portions of the engine to deliver cooling oil to the high pressure pistons 112*a*, 112*b*. For example, oil cooling tubes may be provided to deliver cooling oil through the crankshafts 114*a*, 114*b* and to the high pressure pistons 112*a*, 112*b*.

In the illustrated figure, each high pressure piston 112*a*, 112*b* is positioned approximately 90 degrees before top dead center (top dead center being where the high pressure pistons would be farthest from each of their respective crankshaft's axis of rotation). In a typical implementation, each high pressure piston 112*a*, 112*b* in a common chamber 106 reaches top dead center (that is, a position farthest from its crankshaft's axis of rotation) at substantially the same time. Additionally, in a typical implementation, each high pressure piston 112*a*, 112*b* in a common chamber 106 reaches bottom dead center (that is a position closest to its crankshaft's axis of rotation) at substantially the same time. This arrangement helps balance the momentum of the high pressure pistons' individual momentums.

During operation, the high pressure pistons 112*a*, 112*b* reciprocate relative to the chamber 106 along an axis that is perpendicular to the low pressure piston's axis of movement. In the illustrated implementation, for example, the high pressure pistons 112*a*, 112*b* reciprocate relative to chamber 106 along the x-axis, while the low pressure piston 104 reciprocates along the y-axis.

The engine's combustion chamber 118 is between the far ends of the high pressure pistons 112*a*, 112*b* inside chamber 106. When fuel combusts inside the combustion chamber 118, the high pressure pistons 112*a*, 112*b* are driven apart from one another by the force of the resulting explosion.

Since the combustion chamber 118 is inside the low pressure piston 104 and since the low pressure piston 104 reciprocates relative to the engine casing 102 when the engine is running, the combustion chamber 118 also reciprocates relative to the engine casing 102 when the engine is operating.

The low pressure piston 104 has surfaces that define a portal 120 (or opening) that extends through the low pressure piston 104 and into the combustion chamber 118. The portal 120 has an inner diameter that is sized and arranged to accommodate fuel injection to support engine operation.

A fuel injector 122 is mounted in a support element 123 located next to the low pressure piston 104. The fuel injector 122 has a nozzle 128, for delivering fuel, at a distal end thereof.

The fuel injector's support element 123 defines a passage that supports the fuel injector 122 and defines a opening 125, through which fuel can be delivered. In the illustrated implementation, the fuel injector 122 is arranged so that its nozzle 128 is near the opening 125 so that it can deliver fuel through the opening 125.

The illustrated fuel injector 122 includes a coupling portion 124 that can be coupled to a high pressure fuel delivery line (not shown in FIG. 1). In a typical implementation, there are one or more internal passages in the fuel injector 122 that can carry fuel from the high pressure fuel delivery line to the nozzle 128.

During engine operation, the fuel injector 122 remains stationary relative to the engine casing 102, whereas the low pressure piston 104 reciprocates relative to the engine casing 102 (and, therefore, relative to the fuel injector 122) along the y-axis (i.e., vertically). As the low pressure piston 104 reciprocates, the portal 120 in the low pressure piston 104 moves in and out of alignment with the nozzle 128 at the far end of the fuel injector 122.

In a typical implementation, the fuel injector 122 is operable to inject fuel only when its nozzle is at least substantially aligned with the portal 120 in the low pressure piston 104 and the high pressure pistons 112*a*, 112*b* are at appropriate positions in their respective cycles (typically at or near top dead center).

The fuel injector 122 can be supported in a number of ways. It is generally desirable, however, that the fuel injector 122 remain substantially stationary relative to the engine casing 102 when the engine is operating, even though the combustion chamber 118 is moving relative to engine casing 102 because the high pressure fuel delivery lines (not shown in FIG. 1), which deliver fuel to the fuel injector 122 and which usually are quite rigid, can be coupled to the fuel injector 122 more securely if the fuel injector 122 remains stationary when the engine is operating.

The fuel injector 122 is arranged to inject fuel into the combustion chamber 118 at appropriate times during engine operations to support fuel combustion inside the combustion chamber 118.

Figure 2A:
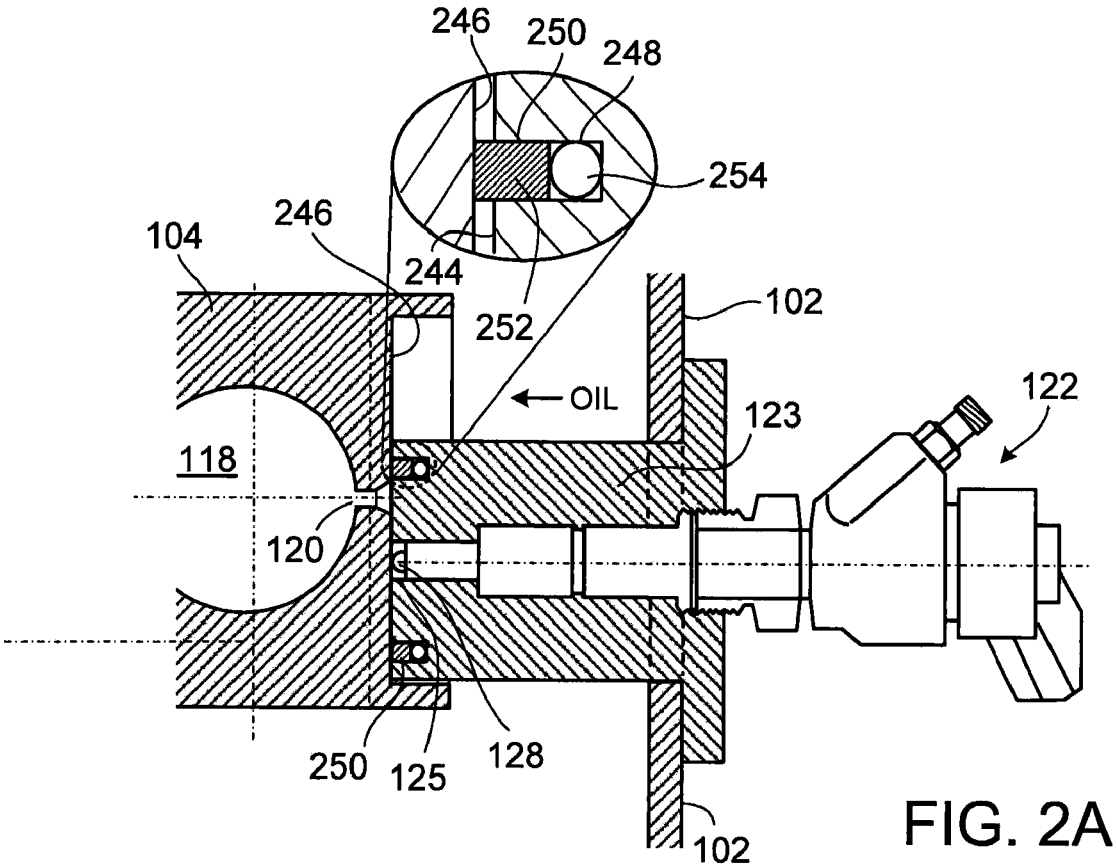
FIGS. 2A-2B are partial cross-sectional side views of an engine at different points during the engine's operations.
Figure 2B:
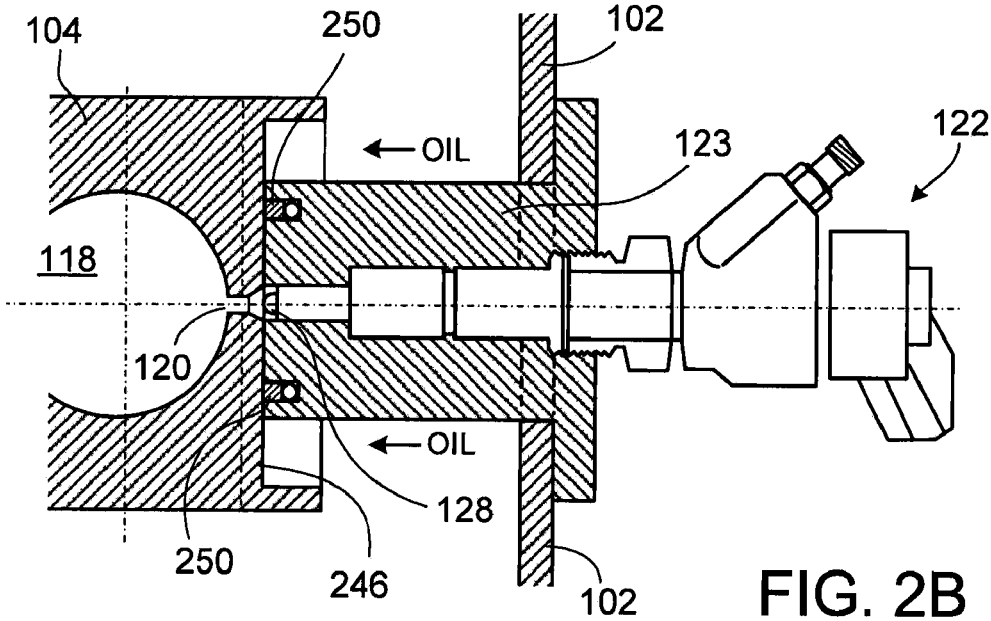

FIGS. 2A and 2B are partial cross-sectional views of engine 100 taken along 2-2 showing the fuel injector 122 rigidly coupled to the engine casing 102 and the low pressure piston 104 being movable relative to the fuel injector 122. More particularly, in FIG. 2A, the low pressure piston 104 is positioned relative to the fuel injector 122 such that the portal 120 is not aligned with the opening 125 in support element 123. In FIG. 2B, the low pressure piston 104 is positioned relative to the fuel injector 122 such that the portal 120 in the low pressure piston is aligned with the opening 125 in support element 123.

According to the illustrated implementation, the fuel injector's support element 123 is securely fastened to the engine casing 102. This fastening can be achieved in a number of ways such as, with screws, nuts and bolts, welding, being integrally cast, etc. Notably, however, bolting (or otherwise removably coupling) the support element 123 to the engine casing 102 can provide ready access to internal engine components for inspection and maintenance purposes.

The illustrated fuel injector body is coupled to its support element 123 by virtue of external threads that are threaded onto corresponding internal threads in the support element 123.

The support element 123 has a substantially flat surface 244 that faces a correspondingly flat surface 246 on the low pressure piston 104.

A substantially annular groove 248 is formed in the flat surface 244 of the support element 123 that faces the correspondingly flat surface 246 of the low pressure piston 104. A substantially annular sealing element 250 is positioned within and partially extends from the annular groove 248 to contact the surface 246 of the low pressure piston 104 facing the sealing element 250. This contact creates a seal that can substantially prevent combustion gases from escaping the combustion chamber 118 through the space between surface 246 of the low pressure piston 104 and the corresponding surface 244 of the fuel injector's support element 123.

In some embodiments, the sealing element 250 is a gapless cast iron ring 252 and an elastomeric o-ring 254 (e.g., a Viton® o-ring, available from E. I. du Pont de Nemours and Company® of Wilmington Del.). The cast iron ring 252 can be lap-fit to a hard-coated flat land on the side of the cylinder and can be sputter-coated with Molybdenum disulfide (MoS2). If an aluminum low pressure cylinder block is used, then the seal land on the low pressure cylinder 104 may be clad with a hard material. There are a variety of other sealing arrangements that are suitable. O-ring squeeze can be measured for reliability and consistency. Resilience is provided by the elastomeric o-ring 254.

In a typical implementation, during engine operation, only the sealing member 150 (and not surface 244 of the fuel injector's support element 122) is in contact with the low pressure cylinder's surface 244.

In some instances, it is desirable to have the diameter of the annular sealing element 250 be as small as possible in order to reduce the amount of hoop tension that may develop as a result from the combustion chamber pressure being applied thereto.

Typically, a small space exists between these surfaces 244, 246. Provisions may be provided to deliver lubricating oil to this small space during engine operation. The oil can be provided by a spraying mechanism directed toward the surface 246 on the low pressure cylinder. This oil can wet the sealing element and be spread into a film by low pressure cylinder's motion.

FIGS. 3A-3F show a progression of cross-sectional schematic views of the engine of FIG. 1 taken along section 3-3 during various stages of operation. Each figure includes a pair of dashed circles (which are overlapping one another in FIGS. 3A and 3D) that represent the relative positions of opening in the injector's support element and the portal 120 into the combustion chamber 118.

FIGS. 3A-3F also show several structural features of engine 100 that are not clearly visible in FIG. 1. For example, an air intake/pre-compression chamber 130 is located inside the engine casing 102 below the low pressure piston 104. The air intake/pre-compression chamber 130 is bounded by a bottom surface 132 of the low pressure piston 104, by a flared cylindrical wall 134 that extends downward from the bottom surface 132 of the low pressure piston 104 and by an inner surface 136 of the intake cylinder head 103.

A pair of annular grooves 138 is formed in an outer surface of the flared cylindrical wall 134 near a far end thereof. In a typical implementation, each groove 138 accommodates a piston ring (not shown). As the low pressure piston 104 moves up and down relative to the engine casing 102, the piston rings slide against (or near) the inner surface 136 of the intake cylinder head 103. The piston rings help reduce undesirable leakage of air out of the air-intake/pre-compression chamber 130 when the engine is operating.

Air intake valves 140 are provided to control air flow into the air intake/pre-compression chamber 130. The air-intake valves 140 can be spring-loaded, for example, and are generally operable to allow air to be drawn into the air intake/pre-compression chamber 130 at appropriate times during engine operation. In the illustrated embodiment, the air intake valves 140 are coupled to and supported by the intake cylinder head 103.

One or more combustion chamber air-intake valves (not shown) are located between the air intake/pre-compression chamber 130 and the engine's combustion chamber 118. The combustion chamber air-intake valves are generally operable to enable air to flow at appropriate times during engine operation from the air-intake/pre-compression chamber 130 into the engine's combustion chamber 118.

An exhaust chamber 142 is located inside the engine casing 102 above the low pressure piston 104. Similar to the air-intake/pre-compression chamber 140, the exhaust chamber 142 is bounded by an upper surface 144 of the low pressure piston 104, by a flared cylindrical wall 146 that extends upward from the upper surface 144 of the low pressure piston 104 and by an inner surface 148 of the exhaust cylinder head 105.

As with the air-intake/pre-compression chamber 130, a pair of annular grooves 150 is formed in an outer surface of the flared cylindrical wall 146 near a far end thereof. In a typical implementation, each groove 138 is sized to accommodate a piston ring (not shown). As the low pressure piston 104 moves up and down relative to the engine casing 102, the piston rings slide against (or near) the inner surface 148 of the exhaust cylinder head 105. The piston rings help reduce undesirable leakage of exhaust gases out of the exhaust chamber 142 when the engine is operating.

The contact (or close fit) between the piston rings and the inner surface 136 of the intake cylinder head 103 and the contact (or close fit) between the piston rings and the inner surface 148 of the exhaust cylinder head 105 help index (or regulate) the low pressure piston's orientation as it moves up and down inside the engine casing 102.

One or more combustion chamber exhaust valves (not shown) are located between the engine's combustion chamber 118 and the exhaust chamber 142. The combustion chamber exhaust valves are generally operable to enable exhaust gases to flow out of the combustion chamber 118 and into the exhaust chamber 142 at appropriate times during engine operations.

Engine exhaust valves 152 are provided to control the flow of exhaust gases out of the exhaust chamber 142. The engine exhaust valves 152 can be spring-loaded, for example, and are generally operable to allow exhaust gases to exit the exhaust chamber 142 at appropriate times during engine operations. In the illustrated embodiment, the engine's exhaust valves 152 are coupled to and supported by the exhaust cylinder head 105.

Figure 3A:
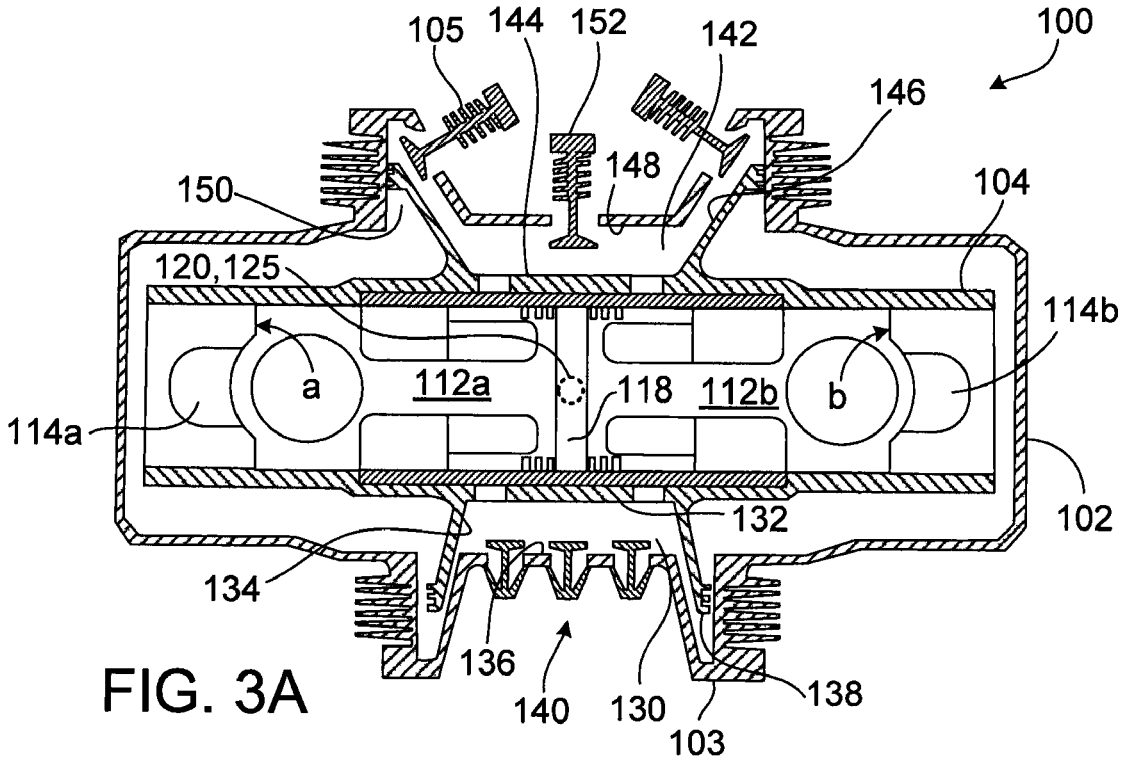
FIGS. 3A-3F are cross-sectional side views of an engine at different points during the engine's operations.

In FIG. 3A, the low pressure piston 104 is shown approximately mid-stroke and moving upward. With the low pressure piston 104 at this position, the opening 125 in the fuel injector's support element is substantially aligned with the portal 120 into the combustion chamber 118. Moreover, the high pressure pistons 112*a* and 112*b* are located at approximately top dead center. In a typical implementation, the fuel injector injects fuel into the combustion chamber 118 with the low pressure piston 104 and the high pressure pistons 112*a*, 112*b* positioned substantially as shown.

The injected fuel ignites inside the combustion chamber 118 and is substantially contained therein. The resulting explosion and expansion of combustion gases inside the combustion chamber 118 pushes the high pressure pistons 112*a*, 112*b* apart from one another. As the high pressure pistons 112*a*, 112*b* separate, crankshaft 114*a* rotates in one direction (indicated by arrow "a") and crankshaft 114*b* rotates in an opposite direction (indicated by arrow "b"). As the high pressure pistons 112*a*, 112*b* move apart from one another, the low pressure piston 104 moves in an upward direction relative to the engine casing 102.

In FIG. 3A, the engine's air-intake valves 140 are in an open position. In a typical implementation, the air-intake valves 140 remain in an open position for the entire time (or substantially the entire time) that the low pressure piston 104 is moving upward inside the engine casing 102. This allows air to flow into the engine through the engine's air-intake valves 140 while the low pressure piston 104 is moving upward.

In FIG. 3A, the combustion chamber air-intake valves and combustion chamber exhaust valves are in a closed position. This helps prevent the combustion gases that are expanding inside the combustion chamber 118 from escaping into either the air-intake/pre-compression chamber 130 or the exhaust chamber 142.

As the low pressure piston 104 moves upward inside the engine casing 102, piston rings, which are contained in grooves 138 in the outer surface of flared cylindrical wall 134, remain in contact with or at least very close to the inner surface 136 of the intake cylinder head 103. This substantially seals the air-intake/pre-compression chamber 130 from other areas around the low pressure piston 104 inside the engine casing 102. As such, the low pressure piston's upward motion tends to create a low pressure environment within the air-intake/pre-compression chamber 130. This helps draw air into the air-intake/pre-compression chamber 130 from the engine's ambient environment.

In FIG. 3A, the engine's exhaust chamber 142 contains exhausted combustion gases from an earlier combustion event that occurred in the combustion chamber 118. The engine's 100 exhaust valves 152 are in an open position and thereby enable the combustion gases inside the exhaust chamber 142 to exit the engine 100. In a typical implementation, the exhaust valves 152 remain in an open position for at least part of the time that the low pressure piston 104 is moving upward inside the engine casing 102.

As the low pressure piston 104 moves upward inside the engine casing 102, the piston rings, which are contained in the grooves 150 formed in the outer surface of the of the flared cylindrical wall 146, remain in contact with or at least very close to the inner surface 148 of the exhaust cylinder head 105. This substantially seals the engine's exhaust chamber 142 from other areas of the engine inside the engine casing 102. The low pressure piston's upward motion when the engine's exhaust valves 152 are open helps push combustion gases out of the engine 100.

Figure 3B:
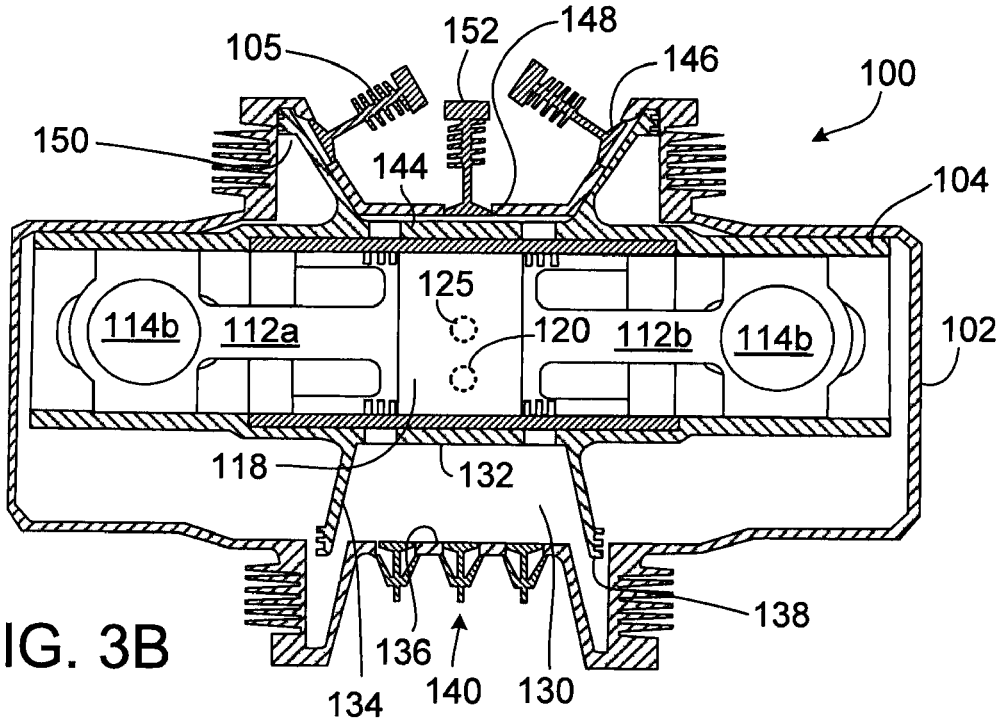
Figure 3C:
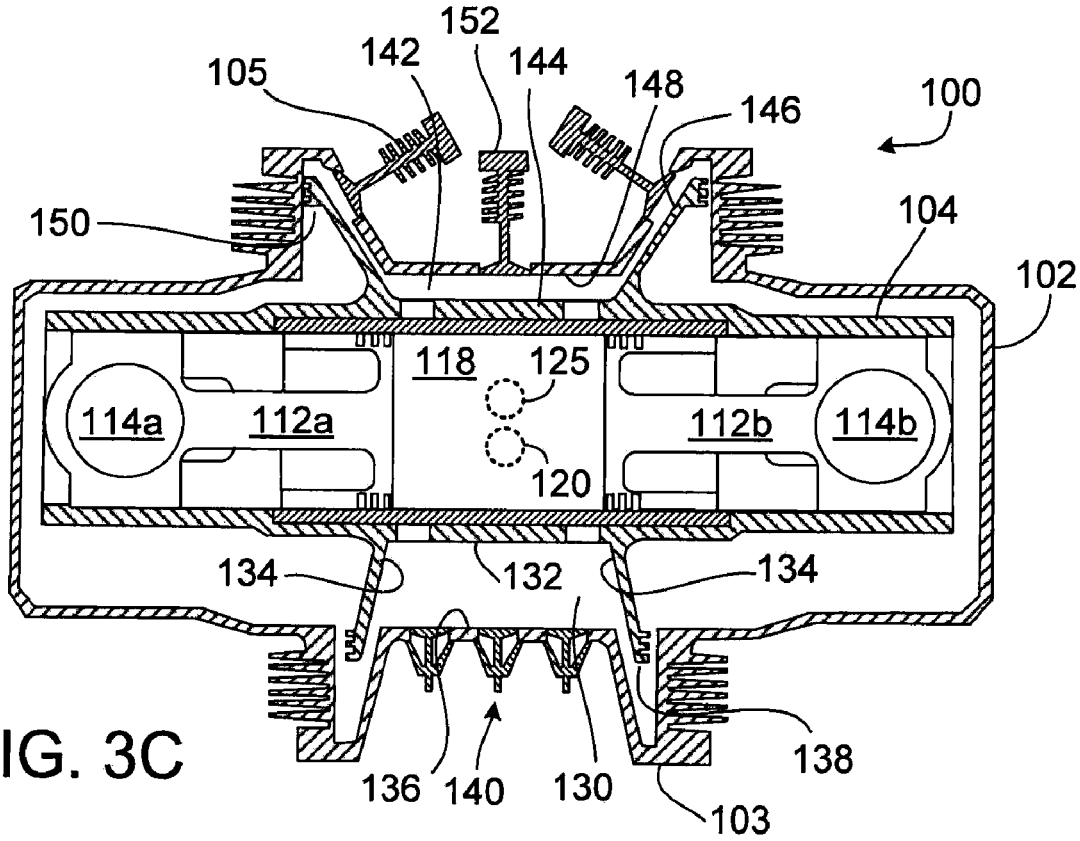

FIG. 3B shows the low pressure piston 104 at the upper end of its stroke inside the engine casing 102. With the low pressure piston 104 in this position, the high pressure pistons 112*a*, 112*b* have traveled about halfway between top dead center (FIG. 3A) and bottom dead center (FIG. 3C). Between FIG. 3A and FIG. 3B, the crankshafts 114*a*, 114*b* have rotated about their respective axes approximately 90 degrees.

In FIG. 3B, the engine's intake valves 140 and exhaust valves 152 are in a closed position. In some embodiments, the engine's intake and exhaust valves 140, 152 close at about the same time that the low pressure piston 104 reaches the end of its stroke closest to the exhaust valves 152.

Moreover, in FIG. 3B, the combustion chamber's air-intake and exhaust valves are closed. This helps keep the combustion gases, which are expanding inside the combustion chamber 118 contained therein.

As the low pressure piston 104 moves between its position shown in FIG. 3A and its position shown in FIG. 3B, the portal 120 in the low pressure piston 104 moves out of alignment with the opening 125 in the fuel injector's support element 123. In a typical implementation, fuel is not injected when the portal 120 in the low pressure piston 104 moves out of alignment with the opening 125 in the fuel injector's support element 123.

Due at least in part to the momentum of the engine's components and to the continuing expansion of combustion gases inside the combustion chamber 118, the high pressure pistons 112*a*, 112*b* in FIG. 3B continue to move apart and the crankshafts 114*a*, 114*b* continue to rotate. Moreover, from its position shown in FIG. 3B, the low pressure piston 104 begins moving downward inside the engine casing 102.

During at least part of the time that the low pressure piston is moving downward the engine's air-intake valves 140 and the combustion chamber's air-intake valves are in a closed position. Accordingly, the downward motion of the low pressure piston 104 compresses the air inside the air-intake/pre-compression chamber 130.

Also, during at least part of the time that the low pressure piston is moving downward the engine's exhaust valves 152 are in a closed position. At this time, the combustion chamber's exhaust valves are open, which enables the combustion gases to flow from the combustion chamber 118 to the exhaust chamber 142. Typically, the combustion gases still are expanding as this occurs. The continued expansion of combustion gases into the exhaust chamber 142, in some implementations, helps urge the low pressure piston 104 to move downward inside the engine casing 102. In some implementations, this enhances the engine's efficiency. Moreover, since the engine's exhaust valves 152 are closed, the downward motion of the low pressure piston 104 creates a low pressure environment inside the exhaust chamber 152 that helps draw the combustion gases out of the combustion chamber 118.

FIG. 3C shows the engine components in a configuration that corresponds to the crankshafts 114*a*, 114*b* being displaced approximately 135 degrees from their positions shown in FIG. 3A when the high pressure pistons 112*a*, 112*b* were at top dead center.

In the illustrated configuration, the combustion gases inside the combustion chamber 118 are continuing to expand and the high pressure pistons 112*a*, 112*b* are continuing to move apart. The low pressure piston 104 is continuing to move downward.

The engine's air-intake valves 140 and the combustion chamber's air-intake valves are in a closed position. Accordingly, the downward motion of the low pressure piston 104 is compressing the air inside the air-intake/pre-compression chamber 130.

The engine's exhaust valves 152 are in a closed position as well. The combustion chamber's exhaust valves are open, which enables the combustion gases to flow from the combustion chamber 118 to the exhaust chamber 142. Typically, the combustion gases still are expanding as this occurs. The continued expansion of combustion gases into the exhaust chamber 142, in some implementations, helps push the low pressure piston 104 to move downward inside the engine casing 102. In some implementations, this enhances the engine's efficiency. Moreover, since the engine's exhaust valves 152 are closed, the downward motion of the low pressure piston 104 creates a low pressure environment inside the exhaust chamber 152 that helps draw the combustion gases out of the combustion chamber 118.

In FIG. 3C, the portal 120 in the low pressure piston 104 is not in alignment with the opening 125 in the fuel injector's support element 123.

Figure 3D:
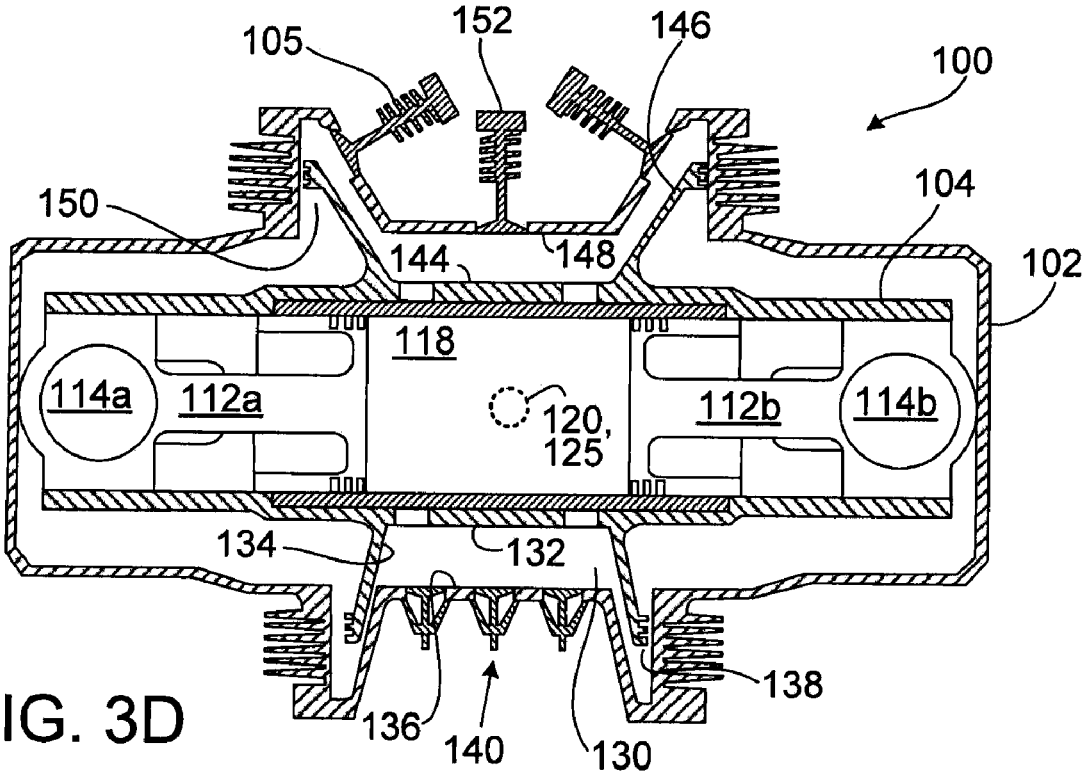

FIG. 3D shows the engine components in a configuration that corresponds to the crankshafts 114*a*, 114*b* being displaced approximately 180 degrees from their positions shown in FIG. 3A when the high pressure pistons 112*a*, 112*b* were at top dead center. Accordingly, the high pressure pistons 112*a*, 112*b* in FIG. 2D are at approximately bottom dead center.

The low pressure piston 104 is continuing to move in a downward direction. In some implementations, at the point in the cycle shown in FIG. 3D, the combustion gases are continuing to expand in the exhaust chamber 142, which contributes to pushing the low pressure piston down in the engine casing 102.

The engine's air-intake valves 140 and the combustion chamber's air-intake valves are in a closed position and so, the downward motion of the low pressure piston 104 continues to compress the air inside the air-intake/pre-compression chamber 130.

The engine's exhaust valves 152 are in a closed position as well. The combustion chamber's exhaust valves are open, which enables the combustion gases to continue to flow out from the combustion chamber 118 into the exhaust chamber 142.

In a typical implementation, although the portal 120 in FIG. 3D is aligned with the opening 125 in the fuel injector's support element 125, fuel injection does not occur. This is because fuel injection at this point in the cycle would not support engine operations.

Figure 3E:
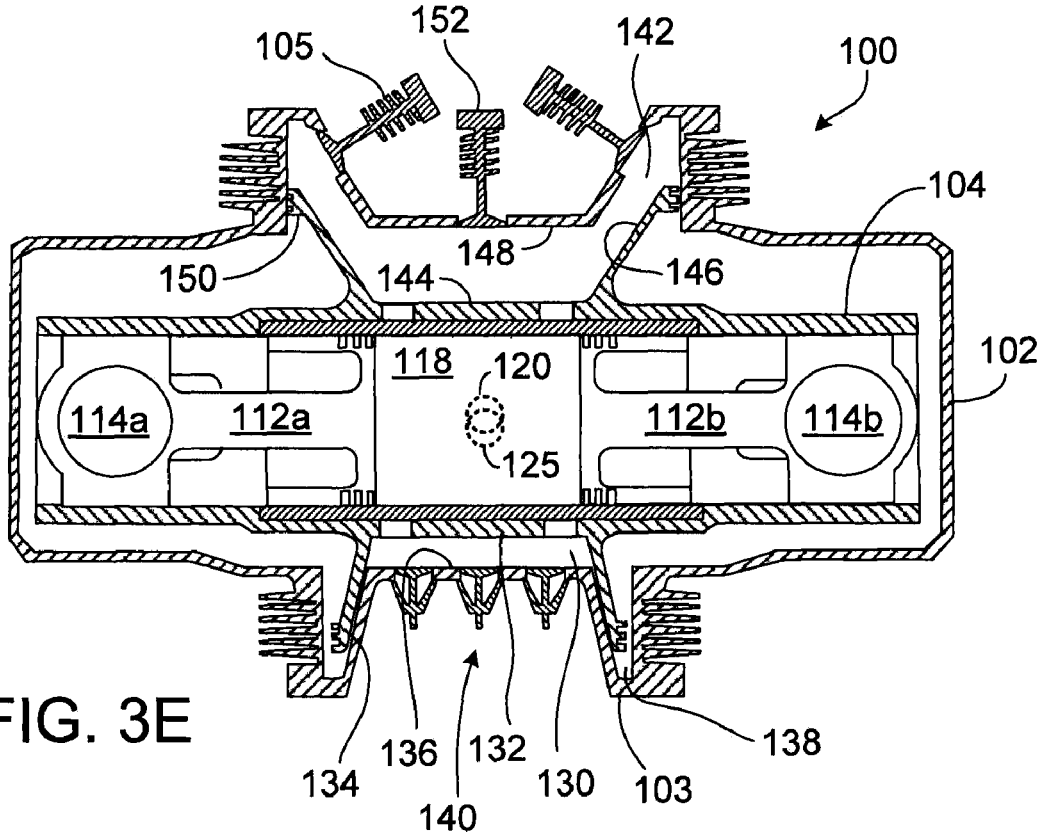

FIG. 3E shows the engine components in a configuration that corresponds to the crankshafts 114*a*, 114*b* being displaced approximately 225 degrees from their positions shown in FIG. 3A when the high pressure pistons 112*a*, 112*b* were at top dead center.

The low pressure piston 104 is continuing to move in a downward direction. The engine's air-intake valves 140 and exhaust valves 152 are in a closed position.

The combustion chamber's air-intake valves are open thereby enabling the compressed air inside the air-intake/pre-compression chamber 130 to be pushed into the combustion chamber. The pressure of the compressed air, as well as the continuing downward motion of the low pressure piston 104 typically results in a large amount of air being pushed into the combustion chamber 118.

At some point either shortly before, shortly after or at substantially the same time that the combustion chamber's air-intake valves open, the combustion chamber's exhaust valves close. The combustion chamber's exhaust valves are operable to allow some, but typically not all of the combustion gases to exit the combustion chamber.

Figure 3F:
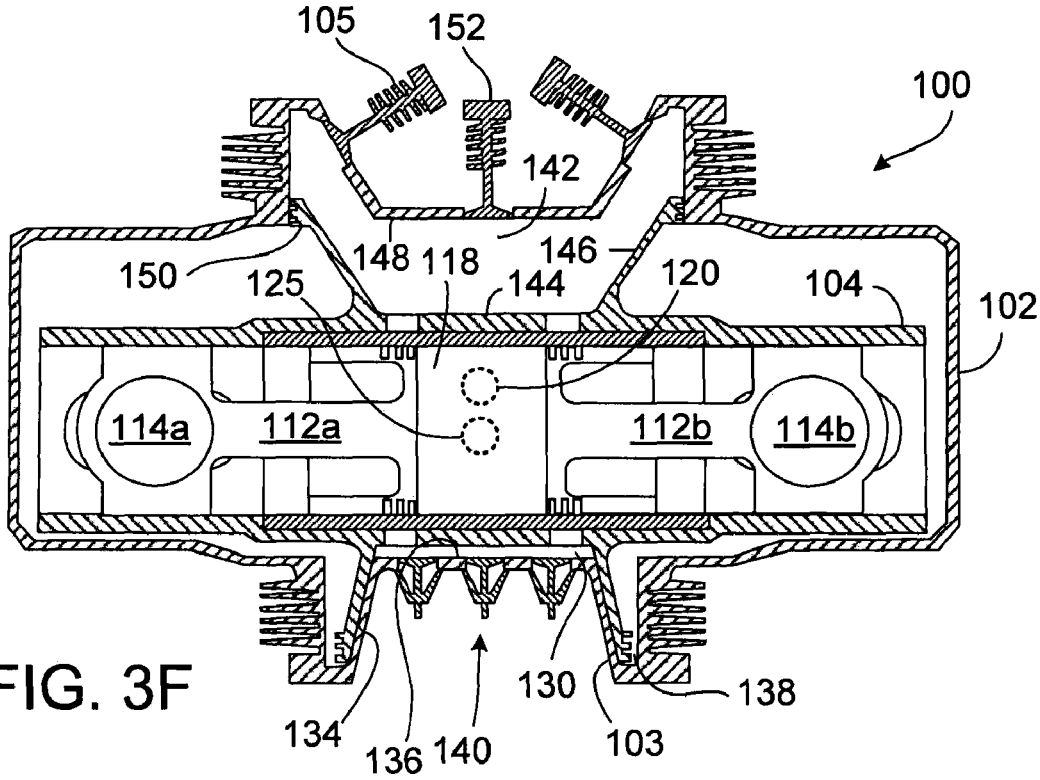

In a typical implementation, once open, the combustion chamber's air-intake valves remain open until the low pressure piston reaches about the bottom of its stroke (as shown in FIG. 3F). Typically, air continues to be pushed into the combustion chamber 118 as long as the combustion chamber's air-intake valves are open and the low pressure piston 104 is moving in a downward direction.

In FIG. 3E, the engine's high pressure pistons 112*a*, 112*b* are moving toward one another. In a typical implementation, with the engine components configured as shown in FIG. 3E, the space between the two high pressure pistons 112*a*, 112*b* and the air-intake/pre-compression chamber 130 has a volume that is decreasing. As the volume decreases, the air moving from the air-intake/pre-compression chamber 230 into the combustion chamber 218 is compressed.

Moreover, in FIG. 3E, the portal 120 in the low pressure piston 104 is almost out of alignment with the opening 125 in the fuel injector's support element 123.

The engine's exhaust valves 152 and the combustion chamber's exhaust valves are in a closed position.

FIG. 3F shows the engine components in a configuration that corresponds to the crankshafts 114*a*, 114*b* being displaced approximately 270 degrees from their positions shown in FIG. 3A when the high pressure pistons 112*a*, 112*b* were at top dead center. The low pressure piston 104 is at about the lowest point in its stroke. The high pressure pistons 112*a*, 112*b* are moving toward one another and are about midway between bottom dead center (FIG. 3D) and top dead center (FIG. 3A). As shown, the portal 120 in the low pressure piston 104 is not aligned with the opening 125 in the fuel injector's support element 123.

In FIG. 3F, substantially all of the air from the air-intake/pre-compression chamber 130 has been transferred into the combustion chamber 118. The combustion chamber air-intake valves and exhaust valves are in a closed position. The continued movement of the high pressure pistons 112*a*, 112*b* toward one another from their respective positions shown in FIG. 3F further compresses the air inside the combustion chamber 118.

The engine's air-intake valves 140 are in a closed position. The engine's exhaust valves 152 are in a closed position. In a typical implementation, with the engine components configured as shown, the combustion gases have substantially finished expanding.

Typically, the engine's air-intake valves 140 and the engine's exhaust valves 152 move to an open position when or very shortly after the low pressure piston 104 begins moving in an upward direction from its position shown in FIG. 3F.

Figure 4:
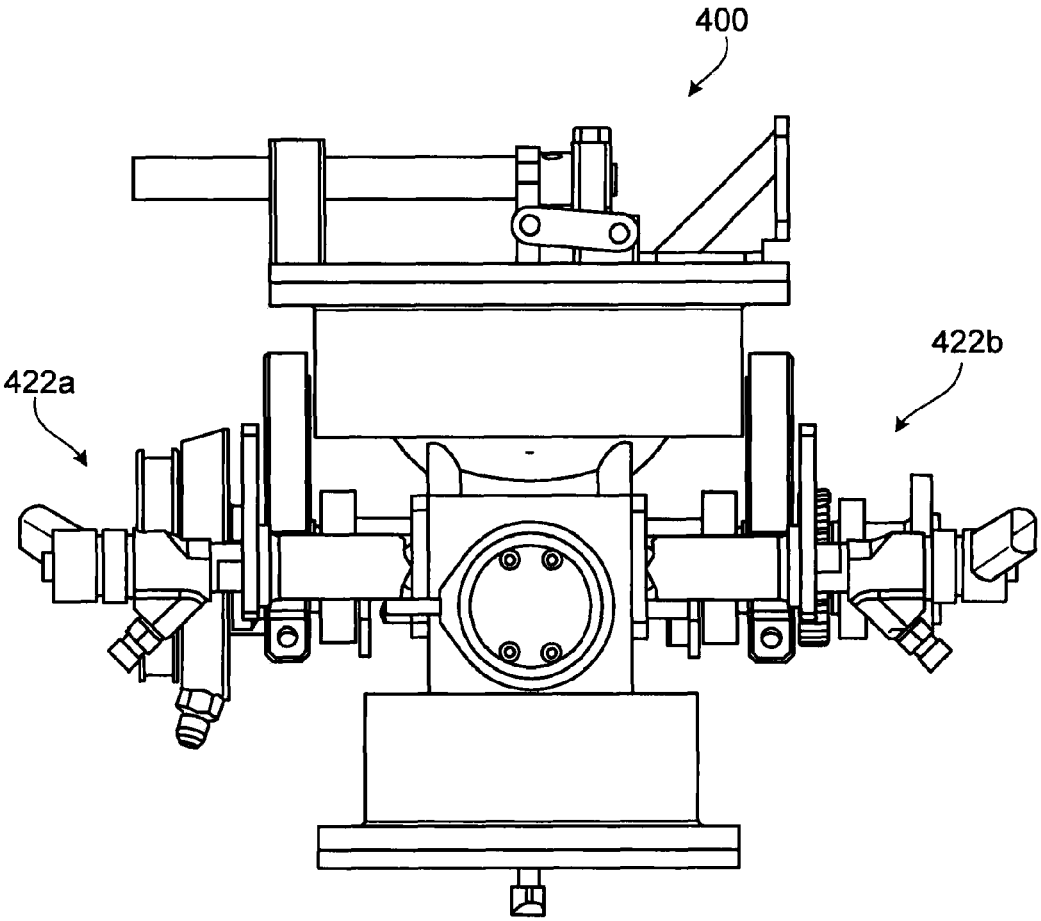
FIG. 4 is a perspective view of an engine with a pair of fuel injectors.

FIG. 4 is a perspective view of portion of an engine 400 that similar to the engine 100 discussed above, except that it includes a pair of fuel injectors 422*a*, 422*b*.

In the illustrated implementation, the fuel injectors 422*a*, 422*b* are arranged to inject fuel into the same combustion chamber from opposite directions. Moreover, the fuel injectors 422*a*, 422*b* are operable so that injection occurs substantially at the same time.

In some implementations, the illustrated arrangement is desirable because during engine operation, pressure from the combustion chamber 118 can exert a force on the outer flat surface 246 of the low pressure cylinder 104 within the confines of the annular sealing element 250. This pressure can develop a side force on the cylinder of some magnitude. By using diametrically opposite injectors, these pressure forces can be substantially balanced, thereby, facilitating centering the low pressure cylinder 104 against side thrusts.

A number of embodiments of the invention have been described. Nevertheless, it will be understood that various modifications may be made without departing from the spirit and scope of the invention.

For example, the specific arrangement and configuration of various engine components can vary. Indeed, in some implementations, certain components may be dispensed with entirely. For example, some implementations can include only one (i.e., not two) high pressure piston arranged for reciprocal motion inside a low pressure piston.

Moreover, the relative arrangement and direction of movement that the various components experience during engine operation can vary as well. So, for example, in some implementations, rather than moving up and down, the low pressure piston may be adapted to move left to right. In such instances, the high pressure pistons may be adapted to move up and down inside the low pressure piston.

The various components disclosed can have a variety of shapes and sizes. The timing of various events during engine operations can vary as well.

The techniques, components and systems disclosed herein can be adapted for use in connection with a variety of different engine styles including, for example, engines that run on diesel fuel or other heavy fuels, engines that run on gasoline or alcohols and engines with or without spark ignition.

Engines implementing the techniques disclosed herein can be used in connection with a wide variety of applications including, for example, aircraft auxiliary power units, alternative light vehicle engines, marine engines, on-highway truck engines, military unmanned aerial vehicles, tactical vehicle engines and aircraft engines.

Moreover, an engine can include several of the arrangements illustrated in FIG. 1, for example, in a stacked configuration. In such an embodiment, the resulting engine would include a pair of crankshafts and the high pressure pistons of each unit in the stack would be coupled to an associated one of the two crankshafts.

Other sealing arrangements may be implemented utilizing, for example, a seal with a metal spring of some sort for resiliency, or a metallic c-ring. Also, an annular groove can be provided in the low pressure piston rather than in the fuel injector's support element to support the gapless annular sealing element.

Other implementations are within the scope of the claims.

What is claimed is:

1. An engine comprising:

a first fuel injector support element having one or more surfaces to support a first fuel injector and define a first opening through which the first fuel injector can inject fuel;

a first piston with one or more surfaces that define a substantially cylindrical inner chamber and a first portal into the substantially cylindrical inner chamber; and one or more second pistons arranged to reciprocate inside the substantially cylindrical inner chamber and to define, in cooperation with the substantially cylindrical inner chamber, a combustion chamber, wherein the first fuel injector support element and the first piston are arranged such that, during engine operation, the first piston reciprocates relative to the first fuel injector support element to thereby cause the first opening and the first portal to move in and out of alignment with one another.

2. The engine of claim 1 further comprising a first fuel injector supported by the first fuel injector support element.

3. The engine of claim 2 wherein the first fuel injector is arranged to inject fuel into the combustion chamber through the first opening and the first portal when the first opening and the first portal are substantially aligned with each other.

4. The engine of claim 3 wherein the fuel injection occurs when the one or more second pistons are positioned at or near top dead center in their respective cycles.

5. The engine of claim 1 further comprising:

a sealing element between the first fuel injector support element and the first piston, wherein the sealing element is arranged to prevent combustion gases from passing through a space that exists between the first support element and the first piston.

6. The engine of claim 5 wherein the sealing element is substantially annular.

7. The engine of claim 6 further comprising:

one or more surfaces that define a substantially annular groove in either the first fuel injector support element or the first piston, wherein the substantially annular sealing element is supported by the substantially annular groove and extends partially out of the substantially annular groove to contact and seal against a surface of whichever of the first fuel injector support element or first piston does not have the substantially annular groove.

8. The engine of claim 7 wherein, during engine operation, the substantially annular sealing element slides against the surface of whichever of the first fuel injector support element or first piston does not have the substantially annular groove.

9. The engine of claim 7 wherein the sealing element comprises:

a compressible portion; and a wearable portion, wherein the compressible portion is at least substantially contained within the substantially annular groove and the wearable portion slides against the surface of whichever of the first fuel injector support element or first piston does not have the substantially annular groove.

10. The engine of claim 7 further comprising an oil delivery mechanism for delivering oil, during engine operation, to the surface against which the sealing element slides.

11. The engine of claim 1 further comprising:

an engine casing, wherein the first fuel injector support element is coupled to the engine casing.

12. The engine of claim 11 wherein the first fuel injector support element is coupled to the engine casing in a manner that enables a user to readily remove the first fuel injector support element from the engine casing.

13. The engine of claim 11 further comprising:

one or more engine intake valves coupled to the engine casing at a first side of the first piston;

a pre-compression chamber between the one or more engine intake valves and the first piston;

one or more engine exhaust valves coupled to the engine casing at a second side of the first piston opposite the first side;

an exhaust chamber between the one or more engine exhaust valves and the first piston.

14. The engine of claim 1 further comprising:

a second fuel injector support element having one or more surfaces to support a second fuel injector and define a second opening through which the second fuel injector can inject fuel, wherein the first piston has one or more surfaces that define a second portal into the substantially cylindrical inner chamber, and wherein the second fuel injector support element and the first piston are arranged such that, during engine operation, the first piston reciprocates relative to the second fuel injector support element to thereby cause the second opening and the second passage to move in and out of alignment with one another.

15. The engine of claim 14 wherein the second fuel injector support element is at a diametrically opposite side of the substantially cylindrical inner chamber relative to the first fuel injector support element.

16. The engine of claim 14 further comprising:

a first fuel injector supported by the first fuel injector support element; and a second fuel injector supported by the second fuel injector support element, wherein, during engine operation, the first and second fuel injectors are operable to inject fuel into the combustion chamber at substantially the same time as one another.

17. The engine of claim 1 comprising:

two second pistons opposing each other inside the substantially cylindrical inner chamber, wherein the combustion chamber comprises a space inside the substantially cylindrical inner chamber between the two opposing second pistons.

18. The engine of claim 1 wherein the first piston further comprises surfaces that define:

one or more combustion chamber intake valves at a first side of the first piston; and one or more combustion chamber exhaust valves at a second side of the first piston, opposite the first side.

19. The engine of claim 1 implemented as a compact compression ignition engine.

20. The engine of claim 1 wherein:

the first piston is arranged to reciprocate along a first axis relative to the engine casing; and the one or more second pistons are arranged to reciprocate along a second axis perpendicular to the first axis.

21. An engine comprising:

a first fuel injector support element having one or more surfaces to support a first fuel injector and define a first opening through which the first fuel injector can inject fuel;

a second fuel injector support element having one or more surfaces to support a second fuel injector and define a second opening through which the second fuel injector can inject fuel;

a first piston having one or more surfaces that define a substantially cylindrical inner chamber, a first portal into the substantially cylindrical inner chamber and a second portal into the substantially cylindrical inner chamber;

one or more second pistons arranged to reciprocate inside the substantially cylindrical inner chamber and to define, in cooperation with the substantially cylindrical inner chamber, a combustion chamber;

wherein the first and second fuel injector support elements are arranged relative to the first piston such that, during engine operation, the first piston reciprocates relative to the first and second fuel injector support elements, to thereby cause the first and second openings to move in and out of alignment with the first and second portals, respectively.

22. The engine of claim 21 further comprising:

a first fuel injector supported by the first fuel injector support element; and a second fuel injector supported by the second fuel injector support element.

23. The engine of claim 22 wherein the first fuel injector is arranged to inject fuel into the combustion chamber through the first opening and the first passage when the first opening and the first portal are in alignment with one another and the one or more second pistons are at or near top dead center in their respective cycles, and wherein the second fuel injector is arranged to inject fuel into the combustion chamber through the second opening and the second passage when the second opening and the second portal are in alignment with one another and the one or more second pistons are at or near top dead center in their respective cycles.

24. The engine of claim 22 wherein the first and second fuel injectors are adapted to inject fuel into the combustion chamber at approximately the same time as one another.

25. The engine of claim 21 wherein the first passage is at a diametrically opposite side of the substantially cylindrical inner chamber as the second passage.

* * * * *